US005327401A

United States Patent [19]

Besson et al.

[11] Patent Number: 5,327,401

[45] Date of Patent: Jul. 5, 1994

[54] WRISTWATCH

[75] Inventors: René Besson; Frank G. Vernay, both of Geneva, Switzerland

[73] Assignee: Montres Rolex S.A., Switzerland

[21] Appl. No.: 916,134

[22] PCT Filed: Dec. 13, 1991

[86] PCT No.: PCT/CH91/00268
§ 371 Date: Jul. 29, 1992
§ 102(e) Date: Jul. 29, 1992

[87] PCT Pub. No.: WO92/10794
PCT Pub. Date: Jun. 25, 1992

[30] Foreign Application Priority Data

Dec. 14, 1990 [CH] Switzerland ..... 3972/90

[51] Int. Cl.[5] ..... G04B 19/24
[52] U.S. Cl. ..... 368/37; 368/28
[58] Field of Search ..... 368/28–40

[56] References Cited

FOREIGN PATENT DOCUMENTS 873520 4/1953 Fed. Rep. of Germany .
2218954 11/1973 Fed. Rep. of Germany .
2519342 11/1975 Fed. Rep. of Germany .
2446355 4/1976 Fed. Rep. of Germany .
321956 7/1957 Switzerland .
0532808 7/1972 Switzerland .
532808 1/1973 Switzerland .

*Primary Examiner*—Bernard Roskoski
*Attorney, Agent, or Firm*—Davis, Bujold & Streck, P.A.

[57] ABSTRACT

The wristwatch displays the date through a window in the dial. To achieve this, the watch comprises a rotatable disc (13) bearing a first series of numbers corresponding to some of the days of the month, and a second series of numbers corresponding to the remaining days, said series being arranged in two concentric circles. To ensure that the date numbers pass the hatch in chronological order, the disc is rotatably driven by a motor (70) combined with an endless screw (71), and translatably driven by a motor (72) combined with an endless screw (73) to pivot a circle sector (74) about a spindle (75). Both said motors are controlled by an electronic circuit (76).

11 Claims, 8 Drawing Sheets

WRISTWATCH

The present invention concerns a wristwatch with a date display in a window on the watch face.

This type of watch with hands, which also indicates the date displays the date either by using an extra hand which points to the thirty-one days of the month arranged in a circle concentric to the hands, or by using a ring showing the thirty-one numbers, in which case the ring rotates for one step each day which equals 360° divided by thirty-one, so that one number appears in a window formed by a rectangular opening on the watch face.

Date display devices are currently equipped with suitable correction means. Theoretically, one of the three positions for the time setting stem is for date correction. When using the watch, the wearer corrects the date until the correct number is displayed. Then during normal use, the watch causes either the hand or the disc to advance one step at midnight so that the correct date is always displayed. In the case of a month which is not a thirty-one day month, the user makes the necessary correction.

The main drawback of such watches is that the small number size affects legibility, especially in womens' watches.

The arrangement of thirty-one numbers on a date indicator ring limits number height to 1/31st of the ring circumference which, for any given radius, imposes a practical limit on number height. This height limitation has been overcome fairly successfully by adding an optical device to the watch glass such as a magnifying lens.

The prior art has proposed multiple solutions, mainly for the system using two contiguous concentric discs, one for displaying double digit and one for single digit numbers. The complexity of these mechanisms and the unattractive appearance of the gap which always remains visible between the two discs have limited the application of this solution.

Solutions using connectors or hooking flexible rings have also been proposed, but in practice are seldom used because they are complex and unreliable.

The present invention proposes overcoming the foregoing disadvantages by providing an effective means of date display which is easily visible and dependable.

To achieve this, the watch according to the invention is characterized in that it comprises a rotatable disc having at least a first series of numbers corresponding to one portion of the thirty-one dates and at least one second series of numbers corresponding to the remaining dates, in that these two series of numbers are arranged on at least two concentric circles, and in that it comprises a mechanism for driving said rotatable disc designed to selectively and automatically move the numbers from the first and second series to the window.

According to an advantageous embodiment, one of the concentric circles has the fifteen even numbers from two to thirty and one blank space, and the other circle has the sixteen odd numbers one through thirty-one, and the numbers on the two circles are arranged so that the chronological order corresponds to a sequence of numbers alternating between the two circles.

Preferably the fifteen even numbers and the sixteen odd numbers are arranged in chronological order on the two respective circles, with the transition from one date to the next corresponding to a 1/32nd disc rotation.

In this embodiment the fifteen even numbers are arranged in this order: 2-24-14-4-26-16-6-28-18-8-30-20-10-22-12 and the sixteen odd numbers in the order 1-23-13-3-25-15-5-27-17-7-29-19-9-31-21-11, with the transition from one date to the next corresponding to one 3/32nd disk rotation.

According to a particularly advantageous embodiment, one of the concentric circles has n numbers arranged in continuous chronological order and the other circle has the next remaining 31−n numbers also arranged in continuous chronological order.

Preferably, the numbers of one series situated on the inside concentric circle are located on a radius of the rotatable disc passing through the middle of the interval separating two numbers in the other series of numbers located on the exterior concentric circle.

In these embodiments, the drive mechanism for the rotatable disc comprises a first motor designed to rotate the disc on its axis and a second motor designed to move it radially in translation.

It is also possible to have a motor for rotating the rotatable disc on its axis and a device to move it translatably and displace its axis from a first to a second position and vice versa.

In this case, the device for displacement in translation comprises a circular portion pivoting on a fixed axis and holding the rotatable disc, and a motor designed to pivot said second sector around its fixed axis.

The drive mechanism for the rotatable disc advantageously comprises an eccentric driven by a motor designed to cause it to make a half rotation for each advance of the rotatable disc, and two detents, essentially diametrically opposed, designed to cooperate with the teeth of a star-shaped date disc connected to said rotatable disc, to make the disc advance one step for each half rotation of said excentric.

According to another embodiment, the mechanism driving the rotatable disc may consist of an interiorly toothed wheel with seventeen teeth and an exteriorly toothed wheel with sixteen teeth designed to roll inside the first wheel, said exteriorly toothed wheel, called the star-shaped date wheel, being connected to the rotatable disc to simultaneously drive it in rotation and displace its axis in translation, or it may be an interiorly toothed wheel with nineteen teeth and a star-shaped exteriorly toothed wheel, called the date wheel, with sixteen teeth, designed to roll inside the first wheel, said exteriorly toothed wheel being connected to the rotatable disc to simultaneously drive it in rotation and to displace its axis in translation.

The present invention will be better understood with reference to the description of one preferred embodiment and variations thereof and to the attached drawing, wherein.

Figure 1:
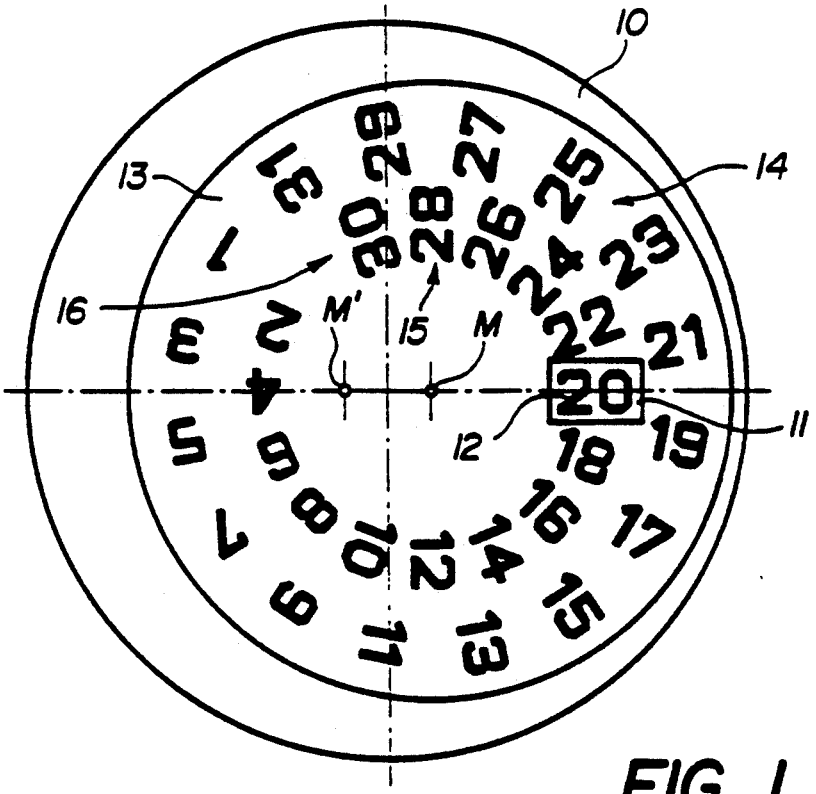
FIGS. 1 and 2 are overhead views of the rotatable date disc of a watch according to the invention in a first position and in a second position, respectively, separated from each other by one step.
Figure 2:
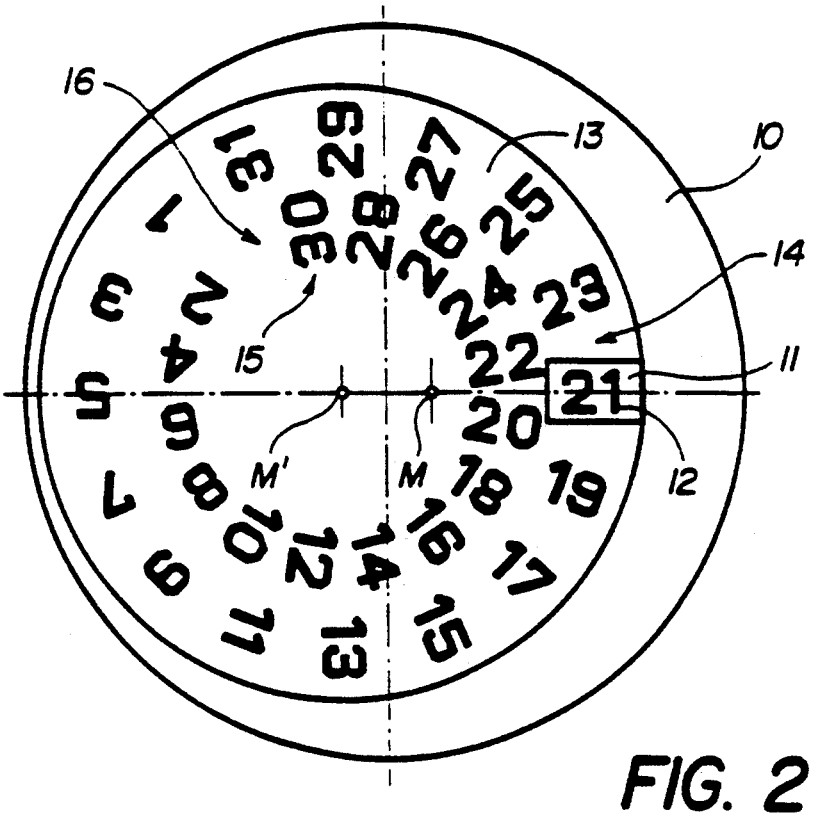

With reference to FIGS. 1 and 2, the watch face 10 which is the subject of the invention is schematically shown by a circle and comprises a window 11 where the date 12 appears (in FIG. 1, the twentieth day of the month and in FIG. 2, the twenty-first). The dates are inscribed on a rotatable disc or ring 13 called the date disc which bears the numbers one through thirty-one corresponding to the maximum number of days in a month. In the embodiment shown in FIGS. 1 and 2, these dates comprise two series of numbers arranged on two concentric circles. The first series 14 comprises sixteen odd numbers from one through thirty-one placed in chronological order and occupies the exterior circle. The second series 15 consists of fifteen even numbers two through thirty also placed in chronological order and occupies the interior circle. A blank space 16 between the two and the thirty completes the second series 15 so that the number of steps necessary to revert to the initial position on each concentric circle is the same, i.e., sixteen.

Note that the numbers on the interior circle are arranged on radii of disc 13 which intersect the center of the interval between two numbers on the exterior circle. The number 2 is between the 1 and the 3, the 4 between the 3 and the 5, the 6 between the 5 and the 7, and so forth. Because of this arrangement, chronological date order results from alternating numbers between the two circles, with the transition from one date to the next corresponding to a 1/32nd disc rotation.

This date arrangement has advantages over the conventional arrangement of successive numbers on the same circle in that it allows number size to be increased considerably without affecting the dimensions of the exterior date disc and consequently, of the watch. However, it also imposes constraints because it requires radial translation displacement in addition to conventional date disc movement so the dates can be chronologically moved to the window. This means that the axis of rotation for the date disc must be displaced from position M to position M' and vice versa.

Figure 3:
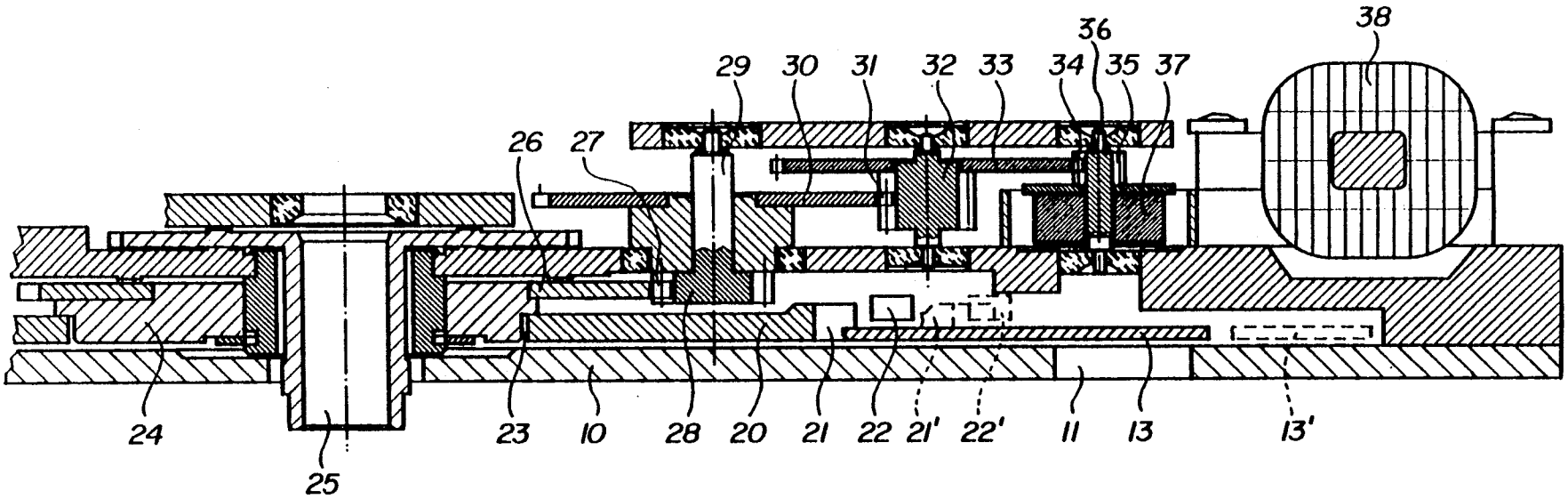
FIG. 3 is a partial cross-section of a preferred embodiment of a watch movement according to the invention in which the date disc corresponds to that shown in the preceding drawings.

The watch whose movement is partially represented in cross-section in FIG. 3 comprises a face 10 with a window 11 and a rotatable date disc 13 which is shown in a first position corresponding to that which it occupies in FIG. 2, shown in cross-section, and in a second position 13', shown by a broken line, corresponding to the position which it occupies in FIG. 1.

The drive mechanism for this date disc comprises a star-shaped date disc 20 consisting of a peripherally toothed portion 21 designed to cooperate with a detent 22. Detent 22 is shown by a solid line in the resting position and by a broken line in the working position, where it bears reference numeral 22', and wherein it engages toothed portion 21' of the star-shaped date disc 20 when the latter is in a separated position corresponding to the separated position 13' of date disc 13. The star-shaped date disc 20 has a circular central groove 23 in which there engages an excentric 24, which is integral with central axis 25 of the movement. This central axis supporting excentric 24 is integral with a wheel 26 centered on axis 25 and engages by means of toothed portion 27 with a pinion 28 held by an axis 29 supporting wheel 30, which engages a pinion 32, integral with wheel 33, by means of toothed portion 31. Wheel 33 comprises a toothed portion 34 which engages a pinion 35 attached to an axis 36 holding a rotor 37 associated with an oscillating motor 38. By virtue of this arrangement, the kinematic chain designed to move the rotatable date disc passes from rotor 37 to star-shaped date disc 20 by the intermediary of a certain number of wheels and pinions, and by means of excentric 24 to cause radially translatable displacement of the date disc from position 13 to position 13' and vice versa.

Figure 4:
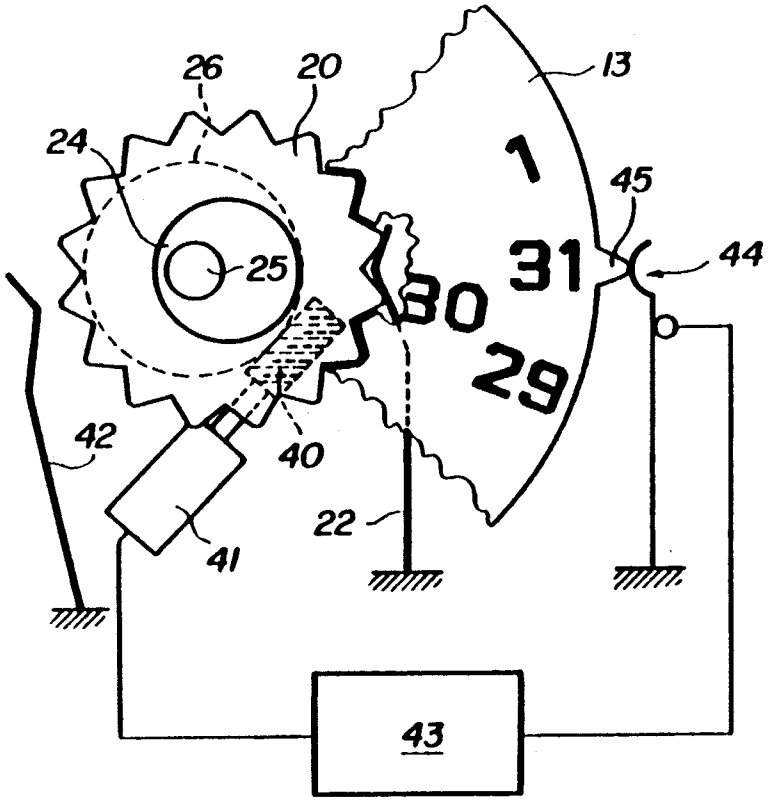
FIG. 4 is an overhead view of a portion of the movement shown in FIG. 3.

This kinematic chain can be simplified, as shown in FIG. 4. This embodiment again comprises date disc 13 made integral with star shaped date disc 20, excentric 24, central axis 25 of the movement, and wheel 26, which in this case engages directly with an endless screw 40 driven by an electric motor 41. Two detents 22 and 42, one of which is armed and the other at rest (in the position shown in the drawing) are designed to alternately index the successive positions of the star-shaped date disc and consequently of the rotatable date disc. The circuit controlling motor 41 is shown schematically by a rectangle 43 to which a contact 44 is connected, designed to cooperate with a projection 45 on the date disc to form an indexing or position detection system for the disc. Closing the contact transmits information to the electronic circuit 43. The electronic circuit may be designed, for example, to interpret this information as an order to the motor to skip a step corresponding to the blank space (the sixteenth position on the interior circle) in order to reach the following step corresponding to the number one on the exterior circle.

Figure 5:
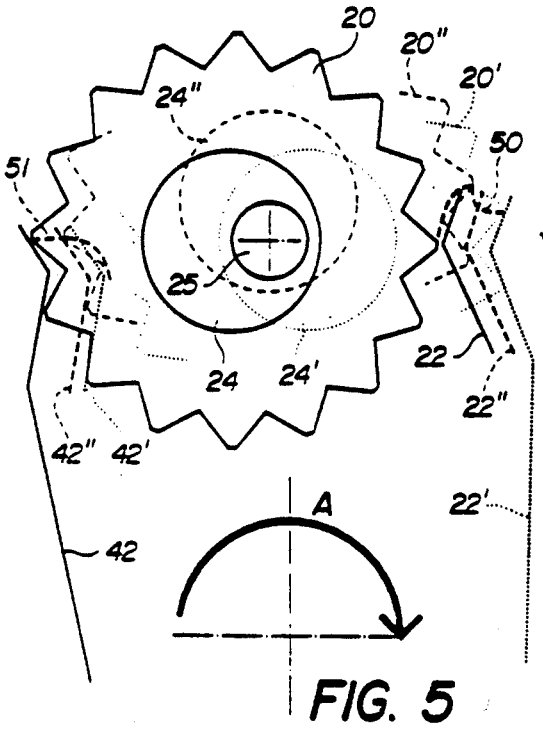
FIGS. 5 through 8 show the principal phases of the movement of FIG. 4 necessary to engender one step in one direction and in the opposite direction, respectively.
Figure 7:
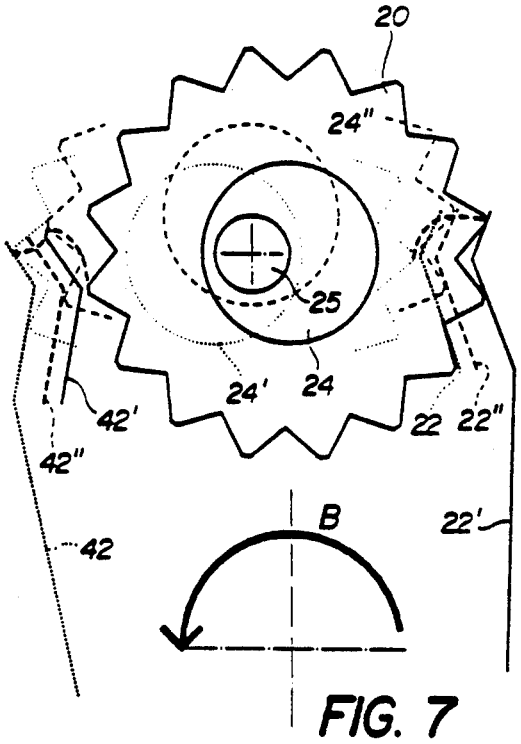
Figure 6:
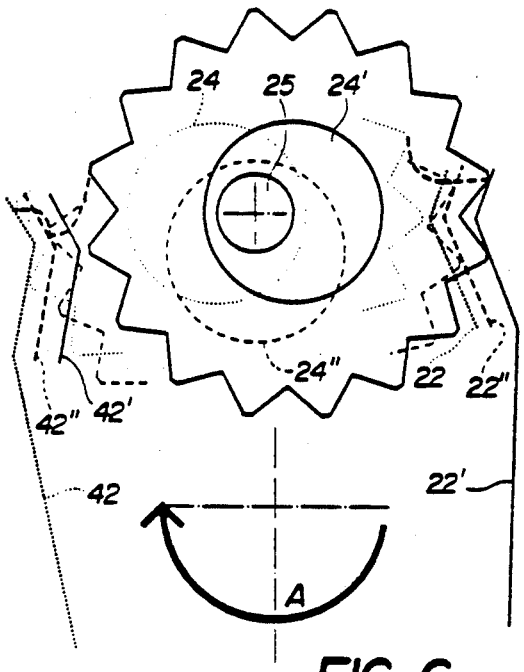
Figure 8:
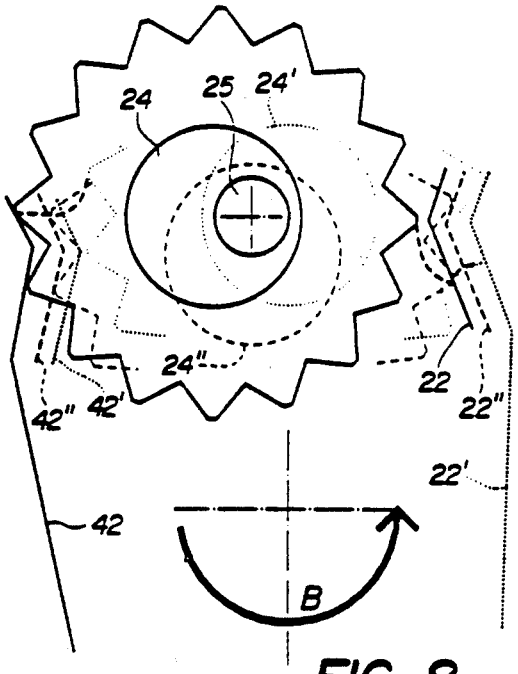

As stated above, FIGS. 5 and 6 show displacement of the star-shaped date disc in the direction of arrow A, or clockwise, and FIGS. 7 and 8 show displacement in the direction of arrow B, or counterclockwise. Excentric 24 is shown in solid lines in the initial position, by broken lines in its intermediate position 24'', and by dotted lines in its final position 24''. Three successive positions 20, 20'' and 20' of the star disc correspond to these three positions. Detent 22 occupies positions 22, 22'' and 22' successively. The path of the tip of one tooth on wheel 20, beside detent 22', shown by dotted lines, is shown by curve 50. Detent 42 successively occupies position 42, intermediate position 42'' and final position 42'. The path taken by the tip of the corresponding tooth on star disc 20 is curve 51 shown by a dotted line.

The movement shown in FIG. 5 corresponds to a one-half rotation of central axis 25, which corresponds to a one step displacement of the date disc and a one date increment showing in the watch window. Another one day increment corresponds to the movement shown in FIG. 6, which corresponds to a one-half rotation of central axis 25 in the direction of arrow A. The excentric moves from position 24' to position 24 while passing through intermediate position 24''. The detents respectively return from positions 22' and 42' to positions 22 and 42. The displacement illustrated in FIG. 5 provides for the transition from an odd numbered date shown on the exterior circle to an even numbered date shown on the interior circle, as the date disc will have effected a 1/32nd rotation and a left-to-right translation.

The displacement shown in FIG. 6 provides the transition from an even numbered date on the interior circle to an odd numbered date on the exterior circle, as the date disc will have effected an 1/32nd clockwise rotation and a right-to-left radial translation.

The displacements shown in FIGS. 7 and 8, respectively, are designed for decreasing date order. The displacement shown in FIG. 7 combines a 1/32nd date disc rotation in the counterclockwise direction with a right-to-left radial translation, thereby providing the transition from an even numbered date shown on the interior circle to the preceding odd numbered date located on the exterior circle.

The displacements shown in FIG. 8 provide for the transition from an odd date to the preceding even date by causing a 1/32nd rotation of the date disc in the counterclockwise direction and superimposing on that movement a left-to-right radial displacement.

It is also possible to replace the two positioning detents by two teeth integral with the movement plate. In this case, there will be positioning inaccuracies due to the necessary play between rigid mechanical parts. In reality, without play there would be a risk of jamming in accordance with manufacturing tolerances. This last version results in minimal energy consumption, as there is no detent to arm. This is a surface connection.

Figure 9:
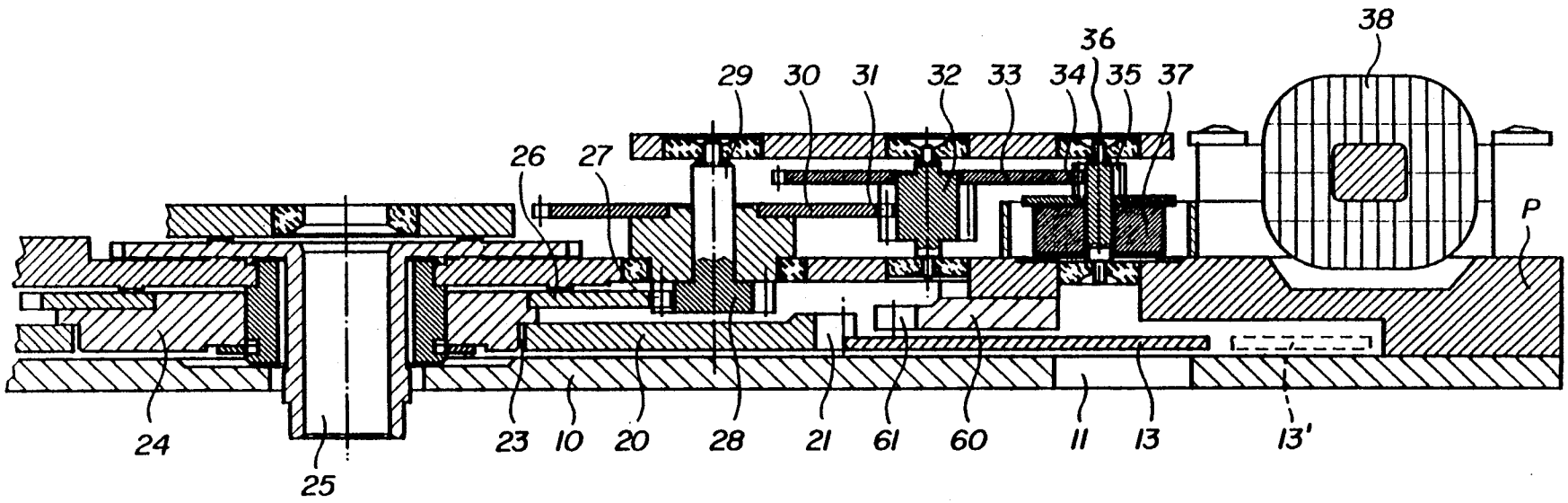
FIG. 9 is a partial cross-section of another embodiment of a watch movement according to the invention with a date disc such as that shown in FIGS. 1 and 2.

The corresponding movement is shown in cross-section in FIG. 9. In this embodiment, most of the elements shown are identical to those shown and described with reference to FIG. 3. For this reason, they bear the same reference numerals and their function will not be described in any further detail. In this embodiment, the detents are replaced by a wheel 60 integral with watch plate P and supporting an interior toothed portion 61. This interior toothed portion 61 has seventeen teeth and cooperates with exterior toothed portion 21 on star-shaped disc 20 which has sixteen teeth and which, as before, remains joined to date disc 13. Thus, each half-rotation of the excentric engenders a displacement in the direction watch movement center-to-window center or vice versa, and a simultaneous 1/32nd rotation of the star-shaped date disc.

Figure 10:
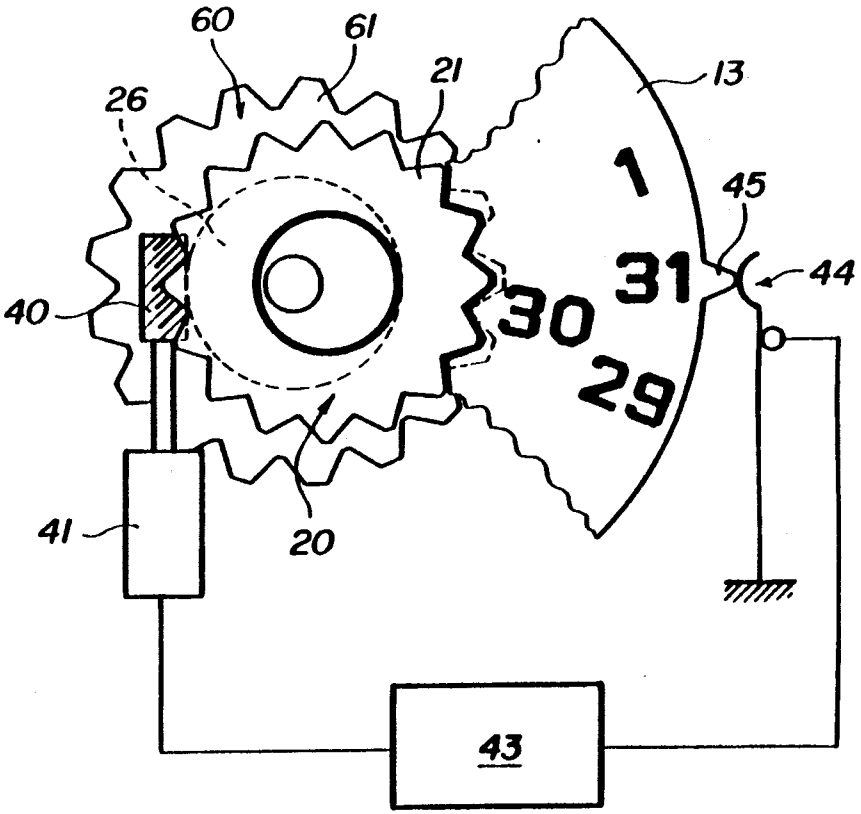
FIG. 10 is an overhead view showing a portion of the watch movement shown in FIG. 9.

A plane view of this mechanism is shown in FIG. 10, but with one variation for the sake of simplifying the drawing: wheel 26, bearing the excentric, is directly driven by an endless screw 40 and a motor 41 which receives control impulses from an electronic circuit 43. A position detector is composed, as before, of a contact 44 and a projection 45 located on the periphery of date disc 13.

Figure 11:
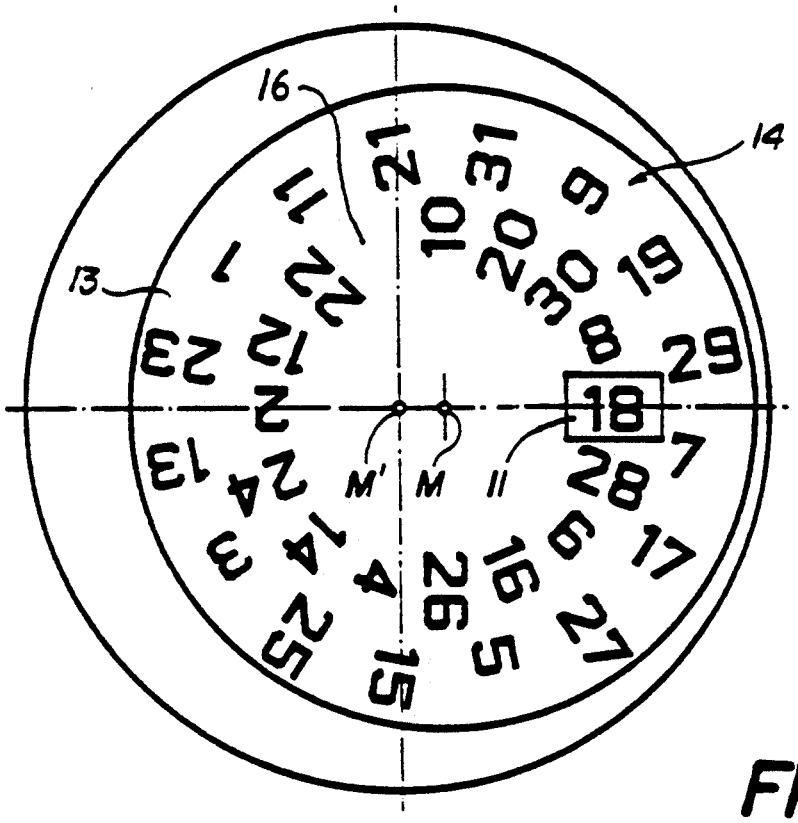
FIGS. 11 and 12 are two views similar to those of FIGS. 1 and 2, but showing a different embodiment of the date disc.
Figure 12:
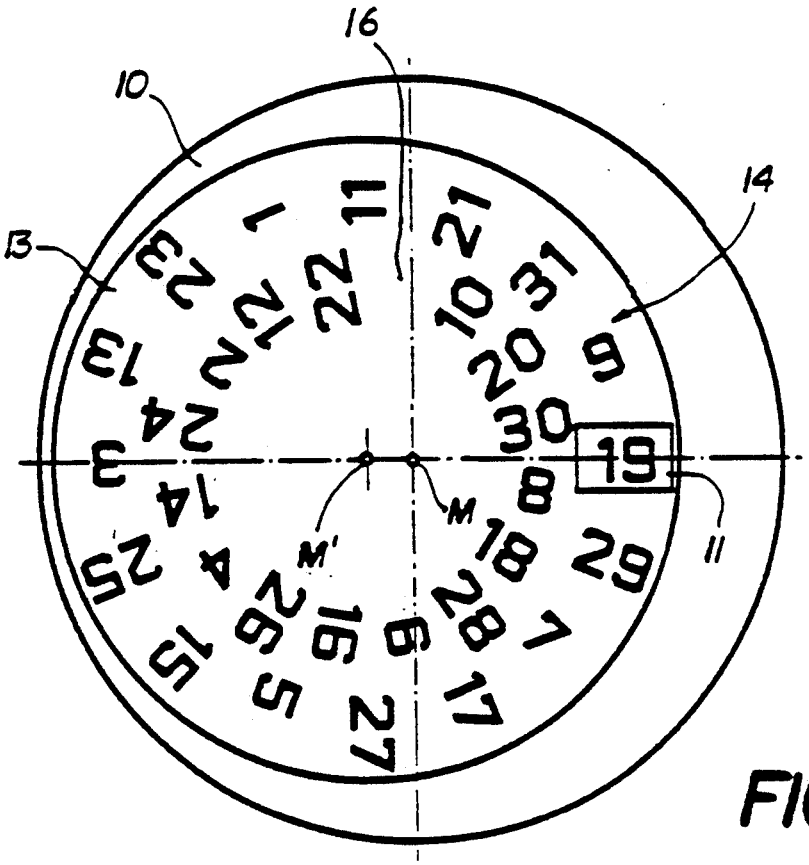

Another arrangement of dates on date disc 13 is shown in FIGS. 11 and 12. This arrangement differs from that shown in FIGS. 1 and 2 in that the dates on the exterior circle (which are odd numbers in the example shown, but may be even numbers) and the dates on the interior circle (which are even numbers in the example shown, but may be odd) are no longer chronologically arranged. The dates on the exterior circle are actually in the order 1-23-13-3-25-15-5-27-17-7-29-19-9-31-21-11 and the dates on the interior circle are in the order 2-24-14-4-26-16-6-28-18-8-30-20-10-22-12. There is a blank space 16, as in the embodiment of FIGS. 1 and 2, in the series on the interior circle. This space is between the ten and the twenty-two.

Because of this arrangement, the chronological sequence of dates is formed by alternating numbers between the two circles. However, the transition from date eighteen (FIG. 11) to date nineteen (FIG. 12) is not accomplished by making the star-shaped date disc turn for a 1/32nd rotation, but for a 3/32nd rotation. In this case, interior toothed portion 61 of wheel 60 comprises nineteen teeth, so that for each half-rotation of the excentric, the star-shaped date disc will advance a 3/32nd rotation. The engaging toothed portion is particularly elegant and easy to manufacture. However, the detent construction such as shown in FIG. 4 is also possible.

Figure 13:
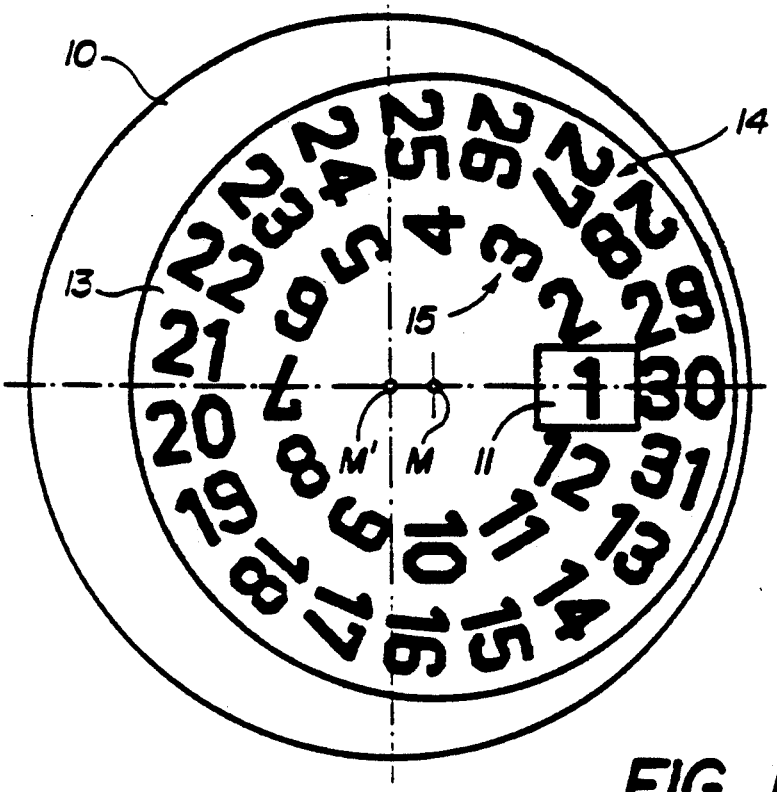
FIGS. 13 and 14 are two views similar to those of FIGS. 11 and 12, but with a different arrangement of dates.
Figure 14:
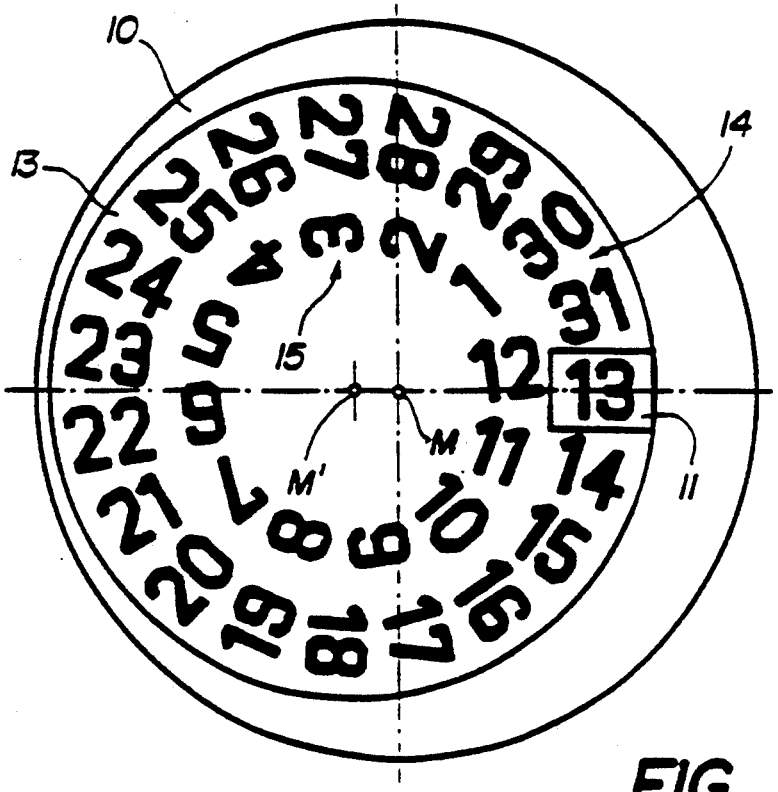

The embodiment shown in FIGS. 13 and 14 provides an arrangement of dates on disc 13 which is quite different from that described above. As before, the dates are disposed on two concentric circles 14 and 15, respectively, but interior circle 15 may have the numbers one through twelve in chronological order and exterior circle 14 may have the numbers thirteen through thirty-one also in chronological order. In this case, the two series are arranged so that the last date on the interior circle, that is, the twelve, is next to the first date on the exterior circle, that is, the thirteen. The first date on the interior circle, that is, the one, is also next to the last date on the exterior circle, that is, the thirty-one. This solution has the advantage of allowing use of larger sized numbers, since in this case it is no longer necessary to have as many dates on the interior circle as on the exterior circle. Actually, in the example shown, the interior circle has twelve numbers, while the exterior circle has nineteen. However, the mechanism designed for date disc displacement causing these dates to move to window 11 in watch face 10 is generally different from that described above. For the first twelve positions, the date disc must be rotatably displaced around an axis corresponding to position M. This rotation displacement corresponds to a 1/12th rotation per step. Then the date disc must be radially displaced so that its center of rotation moves to position M'. Once in this position, it will make a 1/19th rotation each day to successively move the nineteen dates on the circle to window 11. The electronic circuit which accomplishes this is designed so that it controls the oscillation motor for a number of motor steps corresponding to a 1/12th date disc rotation for the first twelve positions and a 1/19th rotation for the next nineteen positions. For example, one rotation equals $8\times12\times19=1824$ motor steps, 1/12 rotation=152 motor steps and 1/19 rotation=96 motor steps or one rotation=$4\times12\times19=912$ motor steps, 1/12 rotation=76 motor steps and 1/19 rotation=48 motor steps. A different date arrangement having n numbers on one circle and $31-n$ on the other, all arranged in continuous chronological order, is also possible.

In an arrangement of dates wherein the exterior circle has a first chronological sequence of numbers and the interior circle has a second chronological sequence of numbers, the watch may use separate motorized means to rotate the date disc for the first sequence and laterally displace it for the second, or more specifically, to move the disc axis in radial translation.

Figure 15:
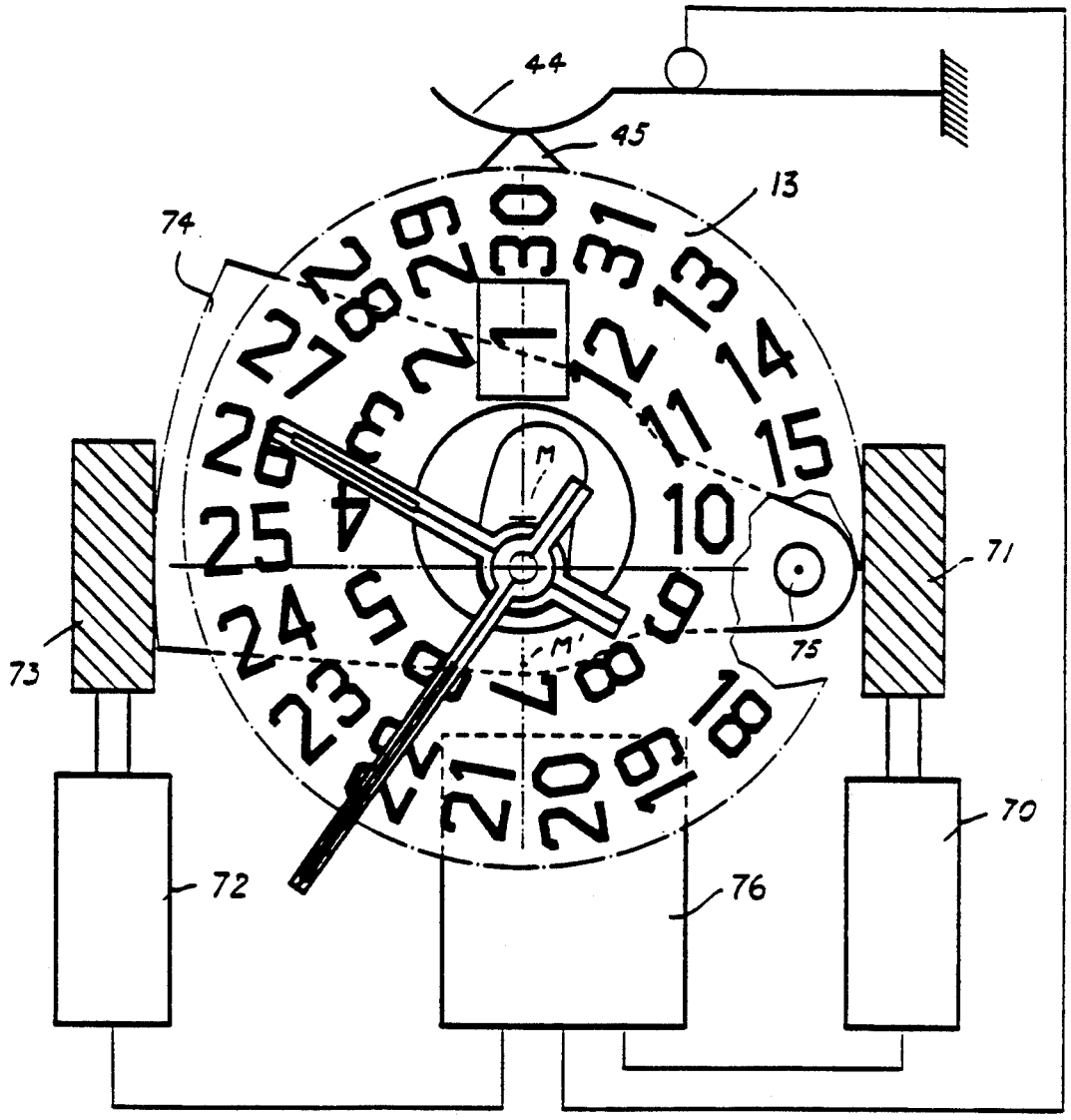
FIG. 15 is a schematic plane view of an advantageous design for the means which displaces the axis of the date disc.

FIG. 15 illustrates an embodiment of this type comprising date disc 13, a first driving motor 70 associated with an endless screw 71 to drive the date disc and a second motor 72 associated with an endless screw 73 to displace a circular portion 74 pivoting about a fixed axis 75 to bring the axis of the date disc into the two positions M and M', respectively, as previously defined. The two motors 70 and 72 are controlled by an appropriate electronic circuit 76. The position of the date disc is detected by a contact 44 cooperating with a projection 45 on the date disc. These two components are identical to those described with reference to FIG. 4.

This solution may also be extended to another embodiment wherein the date disc consists of not two, but three or more concentric circles, each with chronological sequences of dates or some other information to be displayed in one or more windows in the watch face. In this case, the motorized means causing disc rotation and that causing selective displacement of the axis of rotation of said disc may be entirely separate. Moreover, combined mechanisms different from those described above are possible which would provide combined movement of an information disc, specifically a date disc, before being displayed.

The main advantage of the various embodiments described above is that they display information, particularly dates, using larger numbers than those used in conventional systems. Enlarging the numbers does not compromise esthetics or cause insurmountable mechanical problems; the device can function in only one direction if the motor driving the disc is a single direction motor, or it can function in two directions if the motor is a dual direction motor. The motor is also completely shock resistant, even during the phase of transition from one date to another at midnight.

We claim:

1. A wristwatch having a watch face and means for displaying a current date of a month via a window being provided in said watch face, said means for displaying the date comprising a rotatable disc being movable about a rotational axis, said rotatable disc having a first series of numbers comprising a first portion of the thirty-one possible dates of a month and a second series of numbers comprising a remaining portion of the thirty-one possible dates of a month, the first and second series of numbers being arranged in at least first and second concentric circles, and said watch comprises a mechanism for driving said rotatable disc about said rotational axis, wherein said window is dimensioned so as to allow viewing of only one date number at a time from one of said first and second series of numbers, and said mechanism for driving said rotatable disc further includes a mechanism for moving said rotational axis of the rotatable disc radially from a first position in which a desired date number from said first series of number is visible through said window to a second position in which a desired date number from said second series of number is visible through said window.

2. A watch according to claim 1, wherein said first concentric circle contains the fifteen even numbered dates from two to thirty and one blank space and said second concentric circle contains the sixteen odd numbered dates from one to thirty-one, and the numbers are arranged on said first and second concentric circles so that alternating numbers between said first and second concentric circles results in a chronological number sequence.

3. A watch according to claim 2, wherein the fifteen even numbers and the sixteen odd numbers are arranged in chronological order on said first and second concentric circles and transition from one date to the next date corresponds to 1/32nd of a rotation of said rotatable disc.

4. A watch according to claim 1, wherein said first concentric circle contains fifteen even numbers from two to thirty and one blank space arranged thereon in the order of 22-12-2-24-14-4-26-16-6-28-18-8-30-20-10 and said second concentric circle contains the sixteen odd numbers from one to thirty-one arranged thereon in the order 1-23-13-3-25-15-5-27-17-7-29-19-9-31-21-11 and transition from one date to the next date corresponds to 3/32nd of a rotation of said rotatable disc.

5. A watch according to claim 1, wherein said first concentric circle has n date numbers arranged thereon in continuous chronological order and said second concentric circle has 31−n numbers arranged thereon in continuous chronological order.

6. A watch according to claim 1, wherein said mechanism for driving said rotatable disc comprises a first motor for rotating said rotatable disc about said rotational axis and a second motor for moving said rotatable disc radially in translation.

7. A watch according to claim 1, wherein said mechanism for driving said rotatable disc comprises a motor for rotating said rotatable disc about said rotational axis and a device for radially displacing said rotational axis of said rotatable disc from the first position to the second position and vice versa.

8. A watch according to claim 7, wherein the radial displacement device comprises a pivotable member supporting said rotatable disc, said pivotable member is pivotable, adjacent a first end thereof, about a fixed axis and a second motor is positioned, adjacent a second end of said pivotable member, for selectively pivoting said pivotable member about said fixed axis.

9. A watch according to claim 1, wherein a star-shaped date disc, having teeth, is connected to said rotatable disc, said mechanism for driving said rotatable disc comprises an eccentric driven by a motor, said motor causes said eccentric to rotate in half turn increments, and two essentially diametrically opposed detents cooperate with the teeth of said star-shaped date disc to cause said rotatable disc to advance one step to display a next date for each half rotation of said eccentric.

10. A watch according to claim 1, wherein said mechanism for driving said rotatable disc comprises an interior toothed wheel provided with seventeen teeth and an exterior toothed wheel provided with sixteen teeth, said exterior tooth wheel rotates inside said interior toothed wheel, and said exterior toothed wheel is connected to the rotatable disc whereby rotation of said exterior toothed wheel simultaneously rotates said rotatable disc and displaces said rotational axis of said rotatable disc.

11. A watch according to claim 1, wherein said mechanism for driving said rotatable disc comprises an interior toothed wheel provided with nineteen teeth and an exterior toothed wheel provided with sixteen teeth, said exterior tooth wheel rotates inside said interior toothed wheel, and said exterior toothed wheel is connected to the rotatable disc whereby rotation of said exterior toothed wheel simultaneously rotates said rotatable disc and displaces said rotational axis of said rotatable disc.

* * * * *